US010847300B2

(12) United States Patent
Choi et al.

(10) Patent No.: US 10,847,300 B2
(45) Date of Patent: Nov. 24, 2020

(54) INDUCTOR AND METHOD OF MANUFACTURING THE SAME

(71) Applicant: SAMSUNG ELECTRO-MECHANICS CO., LTD., Suwon-si (KR)

(72) Inventors: Jung Woo Choi, Suwon-si (KR); Jin Ho Hong, Suwon-si (KR); Il Jong Seo, Suwon-si (KR); Sa Yong Lee, Suwon-si (KR); Myung Sam Kang, Suwon-si (KR); Tae Hong Min, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 15/642,114

(22) Filed: Jul. 5, 2017

(65) Prior Publication Data

US 2018/0130595 A1 May 10, 2018

(30) Foreign Application Priority Data

Nov. 10, 2016 (KR) ..... 10-2016-0149626

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 27/30*** | (2006.01) |
| ***H01F 41/04*** | (2006.01) |
| *H01F 19/04* | (2006.01) |
| *H01F 27/29* | (2006.01) |

(52) U.S. Cl.

CPC ..... *H01F 27/2804* (2013.01); *H01F 17/0013* (2013.01); *H01F 27/303* (2013.01); *H01F 41/041* (2013.01); *H01F 17/0033* (2013.01); *H01F 19/04* (2013.01); *H01F 27/292* (2013.01); *H01F 2017/004* (2013.01); *H01F 2027/2809* (2013.01)

(58) Field of Classification Search

USPC ..... 336/200

See application file for complete search history.

(56) References Cited

U.S. PATENT DOCUMENTS 8,354,325 B1 * 1/2013 Dao ..... H01L 28/10 257/E21.022
8,384,507 B2 * 2/2013 Li ..... H01F 21/08 336/200

(Continued)

FOREIGN PATENT DOCUMENTS

| | | |
|---|---|---|
| JP | 2001-217550 A | 8/2001 |
| JP | 2002-184638 A | 6/2002 |
| JP | 2010-147217 A | 7/2010 |

*Primary Examiner* — Ronald Hinson

(74) *Attorney, Agent, or Firm* — Morgan, Lewis & Bockius LLP

(57) ABSTRACT

There are provided an inductor and a method of manufacturing the same. The inductor includes: a body including a coil part; and cover parts disposed on upper and lower surfaces of the body. The coil part includes a plurality of through-vias penetrating through the upper and lower surfaces of the body and connection patterns disposed on the upper and lower surfaces of the body, disposed in the cover parts, and connecting the plurality of through-vias to each other.

17 Claims, 6 Drawing Sheets

(56) References Cited

U.S. PATENT DOCUMENTS

| | | | | |
|---|---|---|---|---|
| 2005/0174208 | A1* | 8/2005 | Sato | H01F 17/0033<br>336/200 |
| 2013/0027172 | A1* | 1/2013 | Kuo | H05K 1/165<br>336/200 |
| 2013/0120905 | A1* | 5/2013 | Son | H01F 17/0033<br>361/321.2 |

* cited by examiner

INDUCTOR AND METHOD OF MANUFACTURING THE SAME

CROSS-REFERENCE TO RELATED APPLICATION(S)

This application claims benefit of priority to Korean Patent Application No. 10-2016-0149626 filed on Nov. 10, 2016 in the Korean Intellectual Property Office, the disclosure of which is incorporated herein by reference in its entirety.

TECHNICAL FIELD

The present disclosure relates to a surface mount device (SMD) type inductor, and more particularly, to a vertical inductor used in a high frequency band of 100 MHz or more, and a method of manufacturing the same.

BACKGROUND

In accordance with the trend toward slimness and lightness in electronic products, designs of the electronic products have been complicated and fine, and characteristics of elements of the electronic products have also been complicated, and complex technology has been required in manufacturing the elements of the electronic products.

It has become important that a new method is applied to the elements, the elements have a new structure, while performance and functions of the elements are improved, a cost of the elements is reduced, and a time required for manufacturing the elements is reduced.

Particularly, in accordance with gradual miniaturization of the element, it has been required that a Young's modulus of the element is further improved.

Chip inductors are surface mount device (SMD) type inductor components mounted on a circuit board.

Thereamong, a high frequency inductor refers to a product used at a high frequency of 100 MHz or more.

The most important technical trend in the high frequency inductor is a method of obtaining a high Q value.

The high frequency inductor may be divided into a thin film-type high frequency inductor, a winding-type high frequency inductor, and a multilayer high frequency inductor. The thin film-type high frequency inductor in which a coil is formed by a photolithography process using a photosensitive paste is advantageous for miniaturization.

The winding-type high frequency inductor, manufactured by winding a coil wire, has a limitation in manufacturing an element having a small size.

The multilayer high frequency inductor, manufactured by repeatedly performing a process of printing paste on a sheet and stacking the sheet on which the paste is printed, is advantageous for miniaturization, but has relatively low characteristics.

Recently, at the time of manufacturing the thin film-type inductor, a method of manufacturing the inductor, by forming coils using a semi-additive process (SAP) method using a board and a board material and by sequentially stacking insulating layers using build-up films, is known.

In the high frequency inductor according to the related art, a horizontal inductor in which a coil is perpendicular to a board mounting surface has been mainly used, and in the horizontal inductor, parasitic capacitances between conductors and external electrodes are parallel to each other, such that the parasitic capacitances are increased in accordance with an increase in coil turns. Therefore, a quality (Q) factor is deteriorated.

Meanwhile, in the multilayer high frequency inductor, a photosensitive insulating material is mainly used in order to implement a fine pattern. However, such a photosensitive insulating material has low rigidity, such that a problem may occur in rigidity and reliability of a product.

SUMMARY

An aspect of the present disclosure may provide a vertical inductor used in a high frequency band of 100 MHz or more, and a method of manufacturing the same.

According to an aspect of the present disclosure, an inductor may include: a body including a coil part; and cover parts disposed on upper and lower surfaces of the body. The coil part may include a plurality of through-vias penetrating through the upper and lower surfaces of the body and connection patterns disposed on the upper and lower surfaces of the body, disposed in the cover parts, and connecting the plurality of through-vias to each other.

According to another aspect of the present disclosure, a method of manufacturing an inductor may include: forming a body, wherein the forming of the body includes: preparing a flexible copper clad laminate (FCCL) by applying an insulating material to a copper (Cu) seed layer; forming a plurality of via holes to penetrate through the insulating material vertically; forming a plurality of through-vias by filling the via holes with a metal; forming a copper (Cu) seed layer on an upper surface of the insulating material; laminating dry film resists (DFRs) on upper surfaces of the copper (Cu) seed layers disposed on the upper surface and a lower surface of the insulating material; forming dry film patterns by exposing and developing the dry film resists (DFRs); and forming connection patterns connecting the plurality of through-vias to each other by filling a metal on the dry film patterns.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Inductor

Hereinafter, inductors according to exemplary embodiments in the present disclosure will be described, but the present disclosure is not limited thereto.

Figure 1:
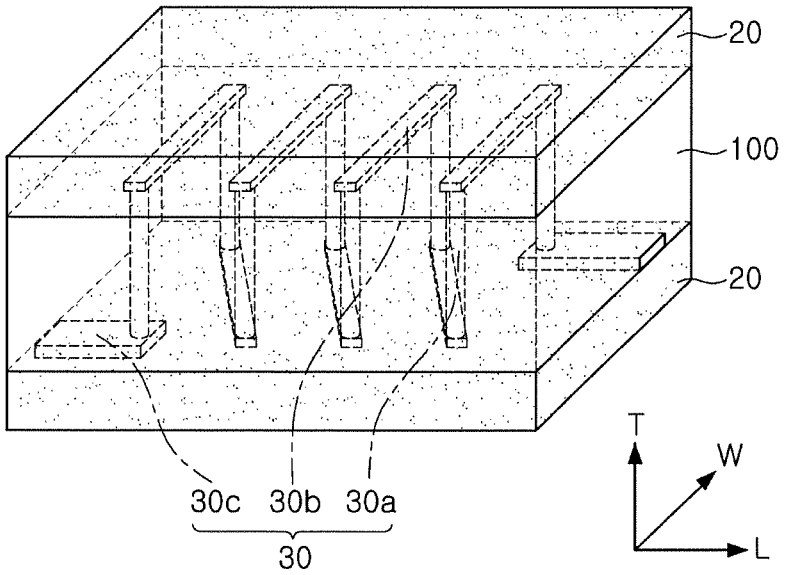
FIG. 1 is a schematic perspective view illustrating an inductor according to an exemplary embodiment in the present disclosure so that a coil part of the inductor is visible.

FIG. 1 is a schematic perspective view illustrating an inductor according to an exemplary embodiment in the present disclosure so that a coil part of the inductor is visible.

Referring to FIG. 1, the inductor according to the exemplary embodiment may include a body 100 including a coil part 30 and cover parts 20 disposed on upper and lower surfaces of the body 100.

The body 100 of the inductor may be formed of a ceramic material such as glass ceramic, $Al_2O_3$, ferrite, or the like, but is not limited thereto. That is, the body 100 may also include an organic component.

The coil part 30 may include a plurality of through-vias 30*a* disposed to penetrate along a thickness direction T through the body 100 from the top of the body 100 toward the bottom of the body 100 and connection patterns 30*b* disposed on the upper and lower surfaces of the body 100 and connecting the plurality of through-vias 30*a* to each other, and may further include lead portions 30*c* for being electrically connected to external electrodes (not illustrated) disposed on external surfaces of the body 100.

The plurality of through-vias 30*a* may be disposed perpendicular to a board mounting surface of the body 100.

The plurality of through-vias 30*a* may be formed by forming vertical via holes in an insulating material constituting the body 100 by laser processing, or the like, and filling the via holes with a metal by a method such as plating or the like.

The via holes may be formed by performing the laser processing, or the like, on the insulating material, but are not limited thereto, and a method of forming the vias (electrodes) by filling the metal in the via holes may be performed by the plating, but is not limited thereto.

Therefore, the plurality of through-vias 30*a* may be disposed to penetrate through the body 100 so as to be exposed to the upper surface and the lower surface of the body 100, and be disposed perpendicular to the board mounting surface of the body 100.

That is, the plurality of through-vias 30*a* may be exposed to the upper and lower surfaces of the body 100.

The connection patterns 30*b* may be metal patterns connecting the plurality of through-vias 30*a* to each other, and the coil part 30 may have a spiral coil shape by the plurality of through-vias 30*a* and the connection patterns 30*b*.

The plurality of through-vias 30*a* may have a cylindrical shape, but are not limited thereto. That is, the plurality of through-vias 30*a* may have various shapes.

In addition, a diameter of each of portions of the plurality of through-vias 30*a* exposed to the upper surface of the body 100 may be greater than that of each of portions of the plurality of through-vias 30*a* exposed to the lower surface of the body 100.

The connection patterns 30*b* may be disposed horizontally to the board mounting surface of the body 100.

In addition, the connection patterns 30*b* may be disposed in the cover parts 20.

The connection patterns 30*b* may be formed by a pattern etching method of performing exposure and development using a dry film resist (DFR) as described below. Therefore, the connection patterns 30*b* may be disposed horizontally on the board mounting surface of the body 100.

The connection patterns 30*b* disposed on the upper surface of the body 100 may have a linear shape in a width direction W of the body 100, and the connection patterns 30*b* disposed on the lower surface of the body 100 may be disposed to connect the plurality of through-vias 30*a* to each other in a diagonal direction which is in or parallel to a width-length plane but not perpendicular to the width direction or parallel to the width direction.

A more detailed description for a method of forming the connection patterns 30*b* will be provided below.

In the high frequency inductor according to the related art, a horizontal inductor in which a coil is perpendicular to a board mounting surface has been mainly used, and in the horizontal inductor, parasitic capacitances between conductors and external electrodes are in parallel with each other, such that the parasitic capacitances are increased in accordance with an increase in the turn of coil. Therefore, a quality (Q) factor is deteriorated.

According to the exemplary embodiment in the present disclosure, a vertical inductor in which the coil part 30 vertical to the board mounting surface is disposed may be implemented by the through-vias 30*a* formed in the body 100 and the connection patterns 30*b* connecting the through-vias 30*a* to each other, such that the parasitic capacitances between the conductors and the external electrodes may be reduced, resulting in improvement of the Q factor.

The inductor according to the exemplary embodiment may include the cover parts 20 disposed on the upper and lower surfaces of the body 100, and the cover parts 20 may be formed of high-rigidity insulating layers having a Young's modulus greater than that of the body 100.

The high-rigidity insulating layers included in the cover parts 20 may have a Young's modulus of 7 GPa or more.

The high-rigidity insulating layers included in the cover parts 20 may further include 50 wt % to 80 wt % of filler, may be manufactured using a thermosetting or photosensitive insulating film having a Young's modulus of 7 GPa or more, and may have a thickness of about 10 to 50 μm.

The coil part 30 may be covered with a thermosetting or photosensitive insulating material, and may have a structure formed of copper (Cu).

The body 100 may include an insulating material having a Young's modulus less than 7 GPa.

The body 100 according to the exemplary embodiment may have a Young's modulus of about 5 GPa, and may include about 42 wt % or less of filler.

A board formed by stacking general organic materials has insufficient rigidity, and a board formed by stacking only high-rigidity materials has good rigidity, but is vulnerable to thermal impact due to a reduction in close adhesion between copper (Cu) and an insulating material, such that a problem may occur in terms of reliability of the board.

According to the exemplary embodiment in the present disclosure, the cover parts 20 including the high-rigidity insulating layers having a high-rigidity material may be introduced onto only the outermost layers of a product to ensure desired strength and secure reliability of the product.

That is, the vertical inductor according to the exemplary embodiment may include the cover parts 20 disposed on the upper and lower surfaces of the body 100 and having the high rigidity to thus have an excellent Young's modulus.

Figure 2:
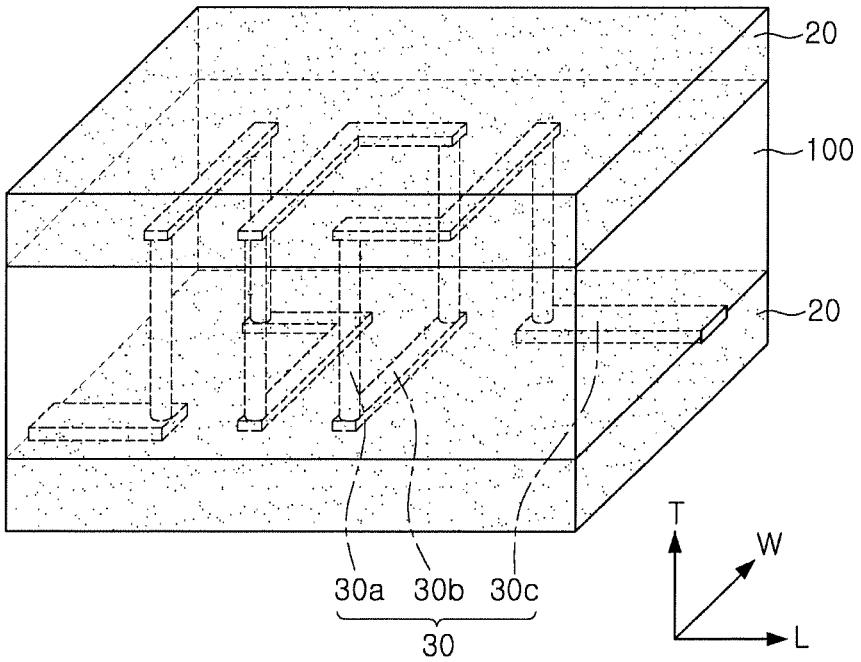
FIG. 2 is a schematic perspective view illustrating an inductor according to another exemplary embodiment in the present disclosure so that a coil part of the inductor is visible.

FIG. 2 is a schematic perspective view illustrating an inductor according to another exemplary embodiment in the present disclosure so that a coil part of the inductor is visible.

Referring to FIG. 2, in a coil part 30 of the inductor according to another exemplary embodiment in the present disclosure, connection patterns 30*b* disposed on the upper and lower surfaces of the body 100 may include linear patterns disposed in the width direction of the body 100, and one or more of the linear patterns may be connected to patterns disposed in a length direction L.

Figure 3:
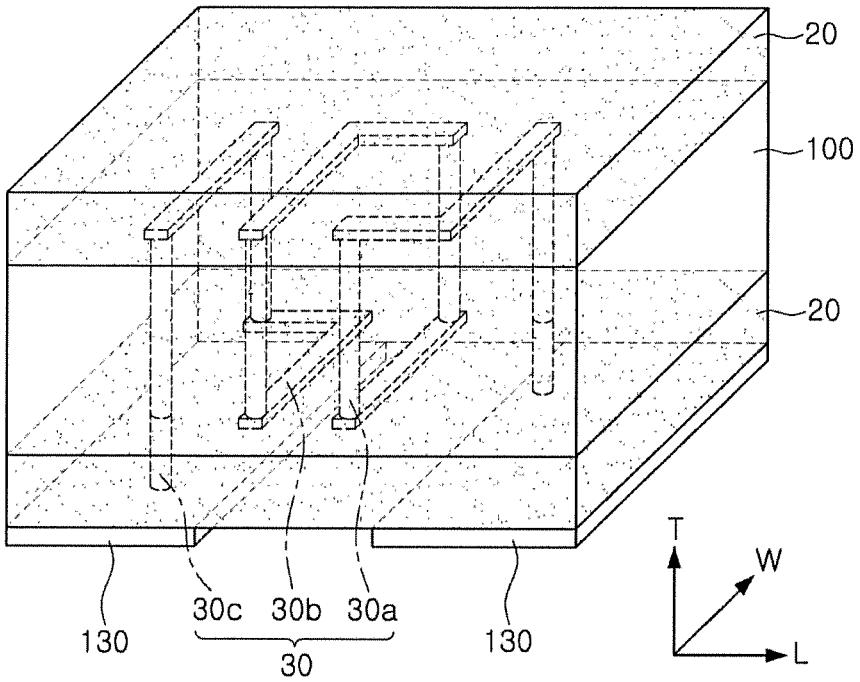
FIG. 3 is a schematic perspective view illustrating an inductor according to another exemplary embodiment in the present disclosure so that external electrodes and a coil part of the inductor are visible.

FIG. 3 is a schematic perspective view illustrating an inductor according to another exemplary embodiment in the present disclosure so that external electrodes and a coil part of the inductor are visible.

Figure 4:
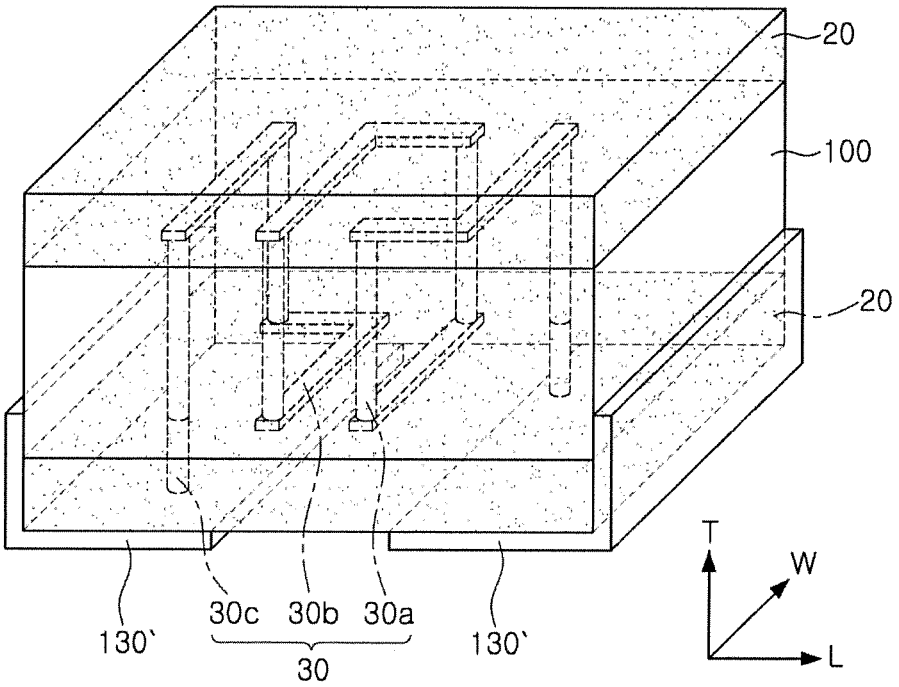
FIG. 4 is a schematic perspective view illustrating an inductor according to another exemplary embodiment in the present disclosure so that external electrodes and a coil part of the inductor are visible.

FIG. 4 is a schematic perspective view illustrating an inductor according to another exemplary embodiment in the present disclosure so that external electrodes and a coil part of the inductor are visible.

The inductor according to another exemplary embodiment in the present disclosure may include a body 100, a coil part 30, cover parts 20, and external electrodes 130.

The external electrodes 130 may be disposed on external surfaces of the body 100 and the cover parts 20, and shapes of the external electrodes 130 are not particularly limited.

The external electrodes 130 may be disposed on the external surfaces of the body 100 and the cover parts 20, may be connected to the lead portions 30*c* of the coil part 30.

In addition, a material of each of the external electrodes 130 is not particularly limited as long as it is a metal that may be plated. For example, the material of each of the external electrodes 130 may be copper (Cu), nickel (Ni), tin (Sn), or mixtures thereof.

Referring to FIG. 3, the external electrodes 130 may be disposed on a lower surface of the inductor, and may be connected to the lead portions 30*c* of the coil part 30 on the lower surface of the inductor.

The lead portions 30*c* may be exposed in the same shapes as those of the through-vias 30*a* from the through-vias 30*a* to the lower surface of the inductor.

Referring to FIG. 4, external electrodes 130' may be disposed on a lower surface of the inductor and side surfaces of the inductor in a length direction L, and may have an L shape.

The external electrodes 130' may be connected to the lead portions 30*c* of the coil part 30 on the lower surface of the inductor.

The lead portions 30*c* may be exposed in the same shapes as those of the through-vias 30*a* from the through-vias 30*a* to the lower surface of the inductor.

An example of a method of manufacturing an inductor according to an exemplary embodiment in the present disclosure will hereinafter be described. However, the present disclosure is not limited thereto.

Method of Manufacturing Inductor

FIGS. 5A through 5H are schematic cross-sectional views illustrating processes in a method of manufacturing an inductor according to an exemplary embodiment in the present disclosure.

According to the exemplary embodiment, a method of manufacturing an inductor may be provided, in which the inductor includes a body including a coil part and cover parts disposed on upper and lower surfaces of the body, and the coil part includes a plurality of through-vias disposed to penetrate through the body from the top of the body toward the bottom of the body and connection patterns disposed on the upper and lower surfaces of the body and connecting the plurality of through-vias to each other.

The respective processes will hereinafter be described in detail.

1. Process of Preparing Flexible Copper Clad Laminate (FCCL) by Applying Insulating Material to Copper (Cu) Seed Layer Referring to FIG. 5A, an insulating material 10*b* having the same thickness as a height of a coil part may be applied to a copper (Cu) seed layer 10*a* to prepare a flexible copper clad laminate (FCCL) 10.

The copper (Cu) seed layer 10*a* may be used to form a plurality of through-vias by forming a plurality of via holes to penetrate through the insulating material vertically 10*b* and then filling the via holes with a metal.

The insulating material 10*b* may become the body 100 of the inductor according to the exemplary embodiment when manufacture thereof is completed, and a material used as a material of a body of a general inductor may be used as the insulating material.

In detail, a thermosetting or photosensitive insulating material may be used as the insulating material 10*b*, and a material having lower rigidity than that of a material of a cover part to be described below may be used as the insulating material 10*b*.

The insulating material 10*b* may be an insulating material having a Young's modulus less than 7 GPa.

In addition, the insulating material 10*b* may have a Young's modulus of about 5 GPa, and may include about 42 wt % or less of filler.

2. Process of Forming a Plurality of Via Holes to Vertically Penetrate Through Insulating Material Referring to FIG. 5B, a plurality of via holes v may be formed to penetrate through the insulating material vertically 10*b*, in order to form a plurality of through-vias.

A method of forming the plurality of via holes v is not particularly limited, but may be performed by, for example, $CO_2$ laser processing.

3. Process of Forming a Plurality of Through-Vias by Filling Metal in Via Holes

Figure 5A:
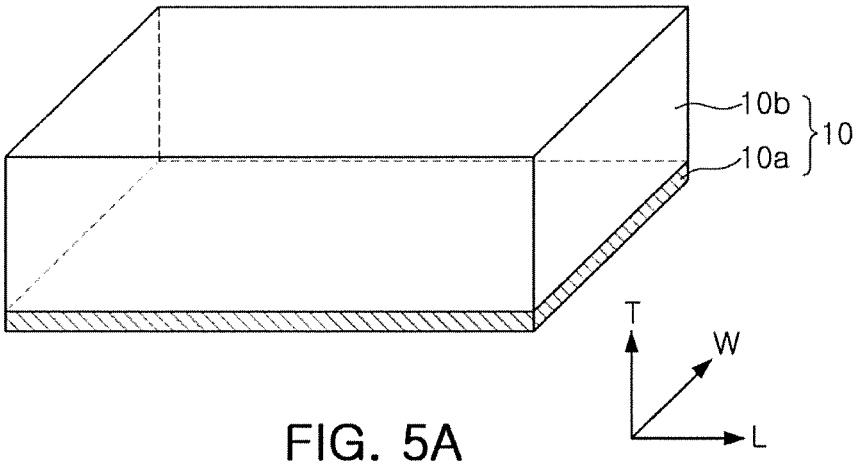
FIGS. 5A through 5H are schematic cross-sectional views illustrating processes in a method of manufacturing an inductor according to an exemplary embodiment in the present disclosure.
Figure 5B:
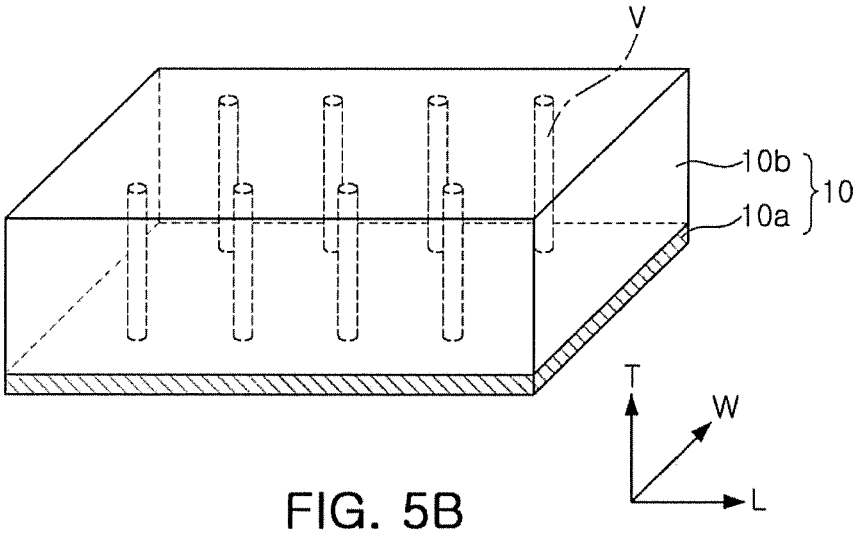
Figure 5C:
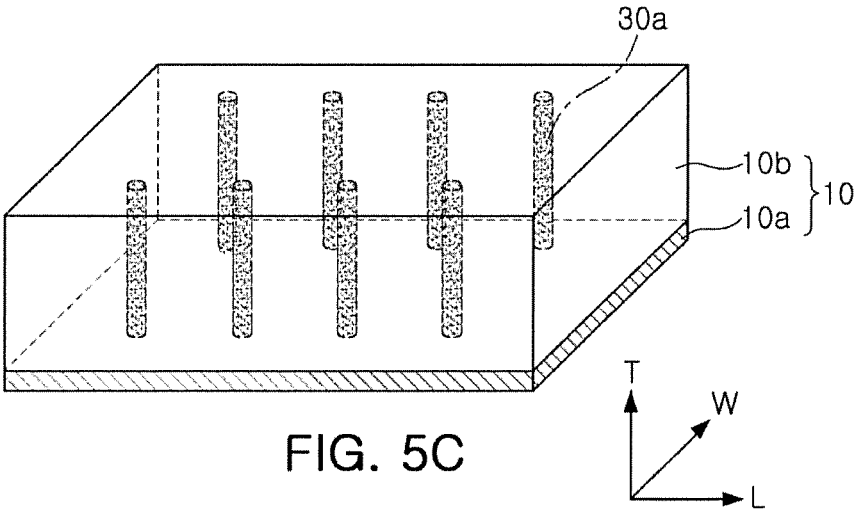
Figure 5D:
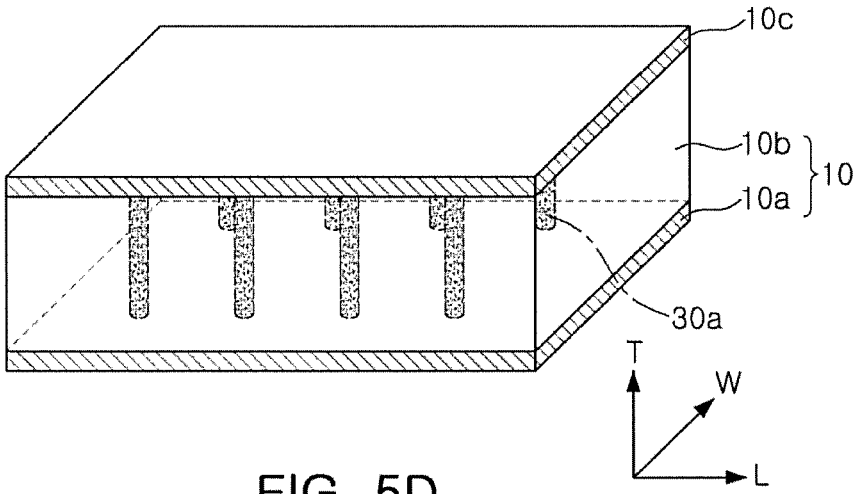
Figure 5E:
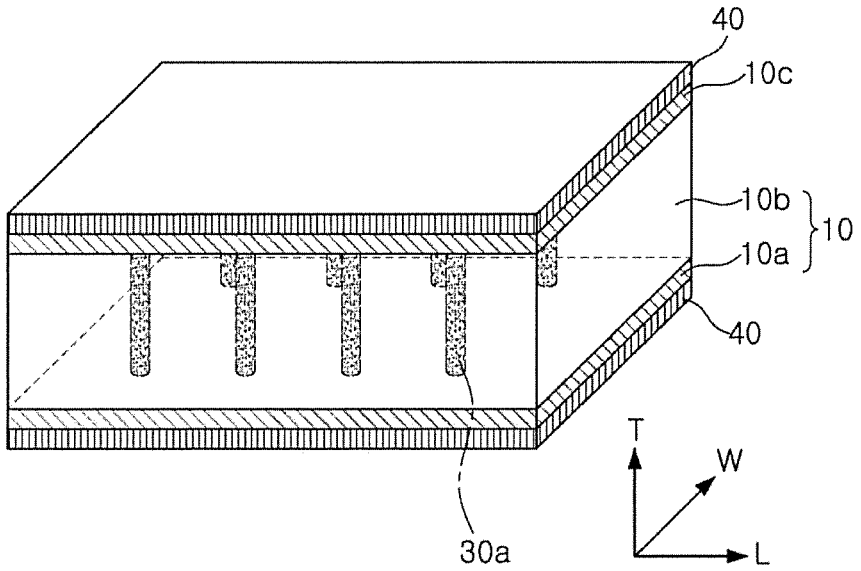

Referring to FIG. 5C, a metal may be filled in the plurality of via holes v to form a plurality of through-vias 30*a*.

Such a process may be performed by filling the metal in the plurality of via holes v by a fill plating process.

The metal is not particularly limited, but may be, for example, copper (Cu), silver (Ag), gold (Au), tin (Sn), or alloys thereof.

According to another exemplary embodiment in the present disclosure, a diameter of each of portions of the plurality of through-vias 30*a* exposed to an upper surface of the insulating material 10*b* may be greater than that of each of portions of the plurality of through-vias 30*a* exposed to a lower surface of the insulating material 10*b* in contact with the copper (Cu) seed layer 10*a*.

4. Process of Forming Copper (Cu) Seed Layer on Upper Surface of Insulating Material Referring to FIG. 5D, a copper (Cu) seed layer 10*c* may be formed on the upper surface of the insulating material 10*b*.

The copper (Cu) seed layer 10*c* may be formed on the upper surface of the insulating material 10*b* in order to be used as a seed layer for forming connection patterns to be described below.

5. Process of Laminating Dry Film Resists (DFRs) on Exterior Surfaces of Copper (Cu) Seed Layers Disposed on Upper and Lower Surfaces of Insulating Material Referring to FIG. 5E, dry film resists (DFRs) 40 may be laminated on exterior surfaces of the copper (Cu) seed layers 10*a* and 10*c* disposed, respectively, on the upper and lower surfaces of the insulating material 10*b*.

Then, the dry film resists (DFRs) 40 may be laminated on the exterior surfaces of the copper (Cu) seed layers 10*a* and 10*c* in order to form the connection patterns.

6. Process of Forming Dry Film Patterns by Exposing and Developing Dry Film Resists (DFRs)

Figure 5F:
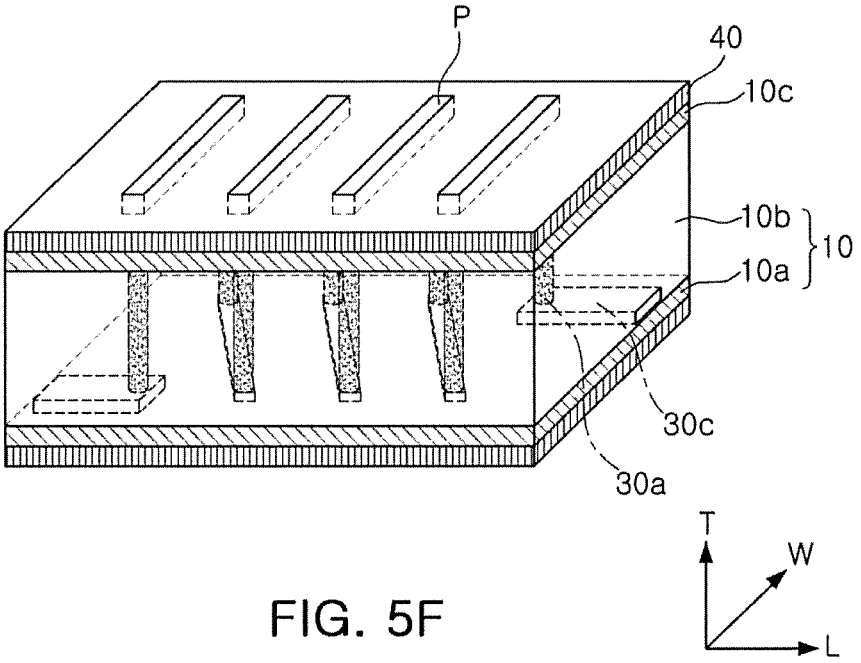

Referring to FIG. 5F, the dry film resists (DFRs) 40 may be exposed and developed to form dry film patterns P.

A method of exposing and developing the dry film resists (DFRs) may be performed by attaching negative dry films to the exterior surfaces of the copper (Cu) seed layers 10*a* and 10*c*, conducting exposure and development, and etching the copper (Cu) seed layers 10*a* and 10*c* through portions in which the negative dry films are removed. In this case, the dry film patterns P may be formed at a width of about 15 μm.

7. Process of Forming Connection Patterns Connecting a Plurality of Through-Vias to Each Other by Filling Metal on Dry Film Patterns Referring to FIG. 5G, a metal may be filled on the dry film patterns P to form connection patterns 30*b* connecting the plurality of through-vias 30*a* to each other.

The connection patterns 30*b* may be disposed horizontally to the board mounting surface of the body 100 formed of the insulating material 10*b*.

The connection patterns 30*b* disposed on the upper surface of the body 100 may have a linear shape in a width direction W of the body 100, and the connection patterns 30*b* disposed on the lower surface of the body 100 may be disposed to connect the plurality of through-vias 30*a* to each other in a diagonal direction.

According to the exemplary embodiment in the present disclosure, a vertical inductor in which the coil part 30 vertical to the board mounting surface is disposed may be implemented by the through-vias 30*a* formed in the body 100, the connection patterns 30*b* connecting the through-vias 30*a* to each other, and the lead portions 30*c*, such that the parasitic capacitances between the conductors and the external electrodes may be reduced, resulting in improvement of the Q factor.

Figure 5G:
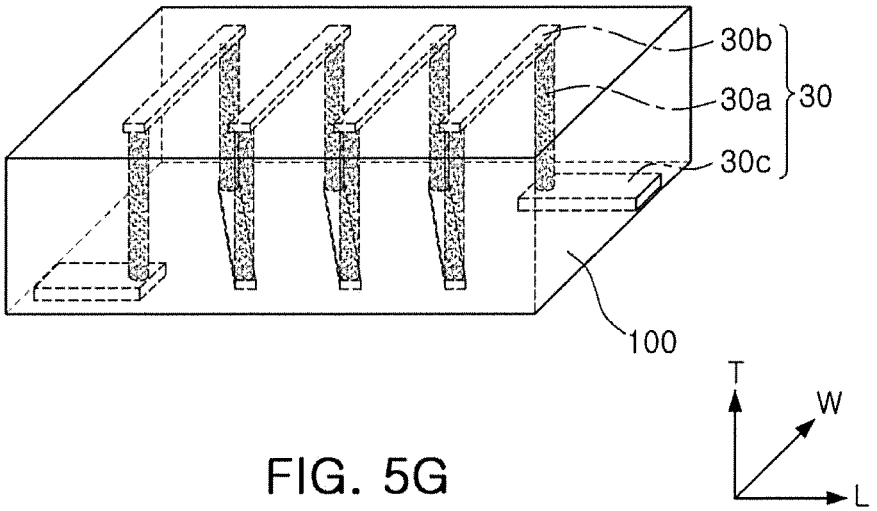

Meanwhile, the coil part 30 may be manufactured so that the connection patterns 30*b* disposed on the upper and lower surfaces of the body 100 include the linear patterns disposed in the width direction W of the body 100 and one or more of the linear patterns may be connected to the patterns disposed in the length direction L, as illustrated in FIG. 2, in addition to the structure illustrated in FIG. 5G.

8. Process of Forming Cover Parts on Upper and Lower Surfaces of Body

Figure 5H:
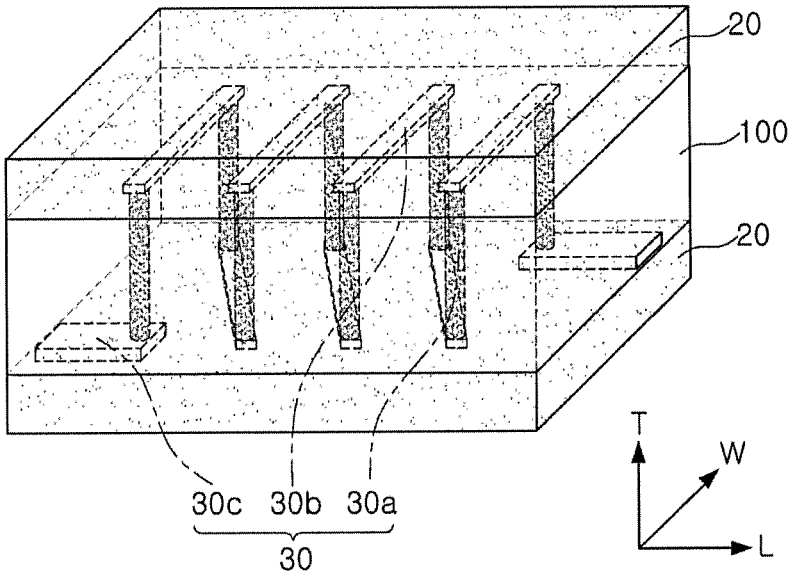

Referring to FIG. 5H, cover parts 20 may be formed on the upper and lower surfaces of the body 100 after a process of forming the body 100 and forming the coil part 30 in the body 100.

The cover parts 20 may be formed of high-rigidity insulating layers having a Young's modulus greater than that of the body 100.

The high-rigidity insulating layers included in the cover parts 20 may have a Young's modulus of 7 GPa or more.

The high-rigidity insulating layers included in the cover parts 20 may further include 50 wt % to 80 wt % of filler, may be manufactured using a thermosetting or photosensitive insulating film having a Young's modulus of 7 GPa or more, and may have a thickness of about 10 to 50 μm.

According to the exemplary embodiment in the present disclosure, the cover parts 20 including the high-rigidity insulating layers having a high-rigidity material may be introduced onto only the outermost layers of a product to ensure desired strength and secure reliability of the product.

That is, the vertical inductor according to the exemplary embodiment may include the cover parts 20 disposed on the upper and lower surfaces of the body 100 and having the high rigidity to thus have an excellent Young's modulus.

As set forth above, according to the exemplary embodiment in the present disclosure, the inductor in which the coil part vertical to the board mounting surface is disposed may be implemented by the through-vias formed in the body and the connection patterns connecting the through-vias to each other, such that the parasitic capacitances between the conductors and the external electrodes may be reduced, resulting in improvement of the Q factor.

In addition, the inductor according to the exemplary embodiment in the present disclosure may include the cover parts disposed on at least portions of the upper and lower surfaces of the body and having the high rigidity to thus have an excellent Young's modulus.

While exemplary embodiments have been shown and described above, it will be apparent to those skilled in the art that modifications and variations could be made without departing from the scope of the present invention as defined by the appended claims.

What is claimed is:

1. An inductor comprising:

a body;

a coil part including a plurality of through-vias penetrating through upper and lower surfaces of the body, and upper connection patterns and lower connection patterns disposed on the upper and lower surfaces of the body, respectively, and connected to the plurality of through-vias; and upper and lower cover parts disposed on the upper and lower surfaces of the body, respectively, and partially embedding the upper connection patterns and the lower connection patterns, respectively, wherein each of the upper connection patterns includes a first surface being in contact with the upper surface of the body, a second surface opposing the first surface and being in contact with the upper cover part, first side surfaces connecting the first and second surfaces to each other and being in contact with the upper cover part, each of the lower connection patterns includes a third surface being in contact with the lower surface of the body, a fourth surface opposing the third surface and being in contact with the lower cover part, second side surfaces connecting the third and fourth surfaces to each other and being in contact with the lower cover part, the upper and lower cover parts, each as an outermost layer of the inductor, include a high-rigidity insulating layer composed of a thermosetting or photosensitive insulating material, the body is composed of another thermosetting or photosensitive insulating material having a Young's modulus less than that of the thermosetting or photosensitive insulating material of the high-rigidity insulating layer, and the high-rigidity insulating layer includes 50 wt % to 80 wt % of filler with respect to an entire content of the high-rigidity insulating layer.

2. The inductor of claim 1, wherein the plurality of through-vias are perpendicular to a board mounting surface of the body.

3. The inductor of claim 1, wherein a diameter of each of portions of the plurality of through-vias exposed to the upper surface of the body is greater than that of each of portions of the plurality of through-vias exposed to the lower surface of the body.

4. The inductor of claim 1, wherein the upper and lower connection patterns are disposed horizontally to a board mounting surface of the body.

5. The inductor of claim 1, wherein the upper connection patterns disposed on the upper surface of the body have a linear shape in a width direction of the body, and the lower connection patterns disposed on the lower surface of the body connect the plurality of through-vias to each other in a diagonal direction.

6. The inductor of claim 1, wherein the upper connection patterns disposed on the upper and lower surfaces of the body include linear patterns disposed in a width direction of the body, and one or more of the linear patterns are connected to patterns disposed in a length direction.

7. The inductor of claim 1, wherein the high-rigidity insulating layer has a Young's modulus of 7 GPa or more.

8. The inductor of claim 1, wherein the thermosetting or photosensitive insulating material of the body has a Young's modulus less than 7 GPa.

9. The inductor of claim 1, wherein the body includes 42 wt % or less of filler with respect to an entire content of the body.

10. The inductor of claim 1, wherein the Young's modulus of the high-rigidity insulating layer is 7 GPa or more, and the Young's modulus of the another thermosetting or photosensitive insulating material of the body is less than 7 GPa.

11. An inductor comprising:

a body;

a coil part including a plurality of through-vias penetrating through upper and lower surfaces of the body, and upper connection patterns and lower connection patterns disposed on the upper and lower surfaces of the body, respectively, and connected to the plurality of through-vias; and upper and lower cover parts disposed on the upper and lower surfaces of the body, respectively, and partially embedding the upper connection patterns and the lower connection patterns, respectively, wherein each of the upper connection patterns includes a first surface being in contact with the upper surface of the body, a second surface opposing the first surface and being in contact with the upper cover part, first side surfaces connecting the first and second surfaces to each other and being in contact with the upper cover part, each of the lower connection patterns includes a third surface being in contact with the lower surface of the body, a fourth surface opposing the third surface and being in contact with the lower cover part, second side surfaces connecting the third and fourth surfaces to each other and being in contact with the lower cover part, the upper and lower cover parts, each as an outermost layer of the inductor, include a high-rigidity insulating layer, and a weight percentage of fillers in the high-rigidity insulating layer with respect to an entire content of the high-rigidity insulating layer is greater than a weight percentage of fillers in the body with respect to an entire content of the body, the weight percentage of the fillers in the high-rigidity insulating layer with respect to the entire content of the high-rigidity insulating layer is 50 wt % to 80 wt %.

12. The inductor of claim 11, wherein the weight percentage of the fillers in the high-rigidity insulating layer with respect to the entire content of the high-rigidity insulating layer is 50 wt % to 80 wt %, and the weight percentage of the fillers in the body with respect to the entire content of the body is 42 wt % or less.

13. The inductor of claim 11, wherein the plurality of through-vias are perpendicular to a board mounting surface of the body.

14. The inductor of claim 11, wherein a diameter of each of portions of the plurality of through-vias exposed to the upper surface of the body is greater than that of each of portions of the plurality of through-vias exposed to the lower surface of the body.

15. The inductor of claim 11, wherein the upper and lower connection patterns are disposed horizontally to a board mounting surface of the body.

16. The inductor of claim 11, wherein the upper connection patterns disposed on the upper surface of the body have a linear shape in a width direction of the body, and the lower connection patterns disposed on the lower surface of the body connect the plurality of through-vias to each other in a diagonal direction.

17. An inductor comprising:

a body;

a coil part including a plurality of through-vias penetrating through upper and lower surfaces of the body, and upper connection patterns and lower connection patterns disposed on the upper and lower surfaces of the body, respectively, and connected to the plurality of through-vias; and upper and lower cover parts disposed on the upper and lower surfaces of the body, respectively, and partially embedding the upper connection patterns and the lower connection patterns, respectively, wherein each of the upper connection patterns includes a first surface being in contact with the upper surface of the body, a second surface opposing the first surface and being in contact with the upper cover part, first side surfaces connecting the first and second surfaces to each other and being in contact with the upper cover part, each of the lower connection patterns includes a third surface being in contact with the lower surface of the body, a fourth surface opposing the third surface and being in contact with the lower cover part, second side surfaces connecting the third and fourth surfaces to each other and being in contact with the lower cover part, the upper and lower cover parts, each as an outermost layer of the inductor, are composed of a high-rigidity insulating layer having a Young's modulus greater than that of the body, the high-rigidity insulating layer has a Young's modulus of 7 GPa or more, and the high-rigidity insulating layer includes 50 wt % to 80 wt % of filler with respect to an entire content of the high-rigidity insulating layer.

* * * * *